US006076455A

United States Patent [19]

Geise

[11] Patent Number: 6,076,455

[45] Date of Patent: Jun. 20, 2000

[54] ALUMINUM CAN COMPACTING MECHANISM

[76] Inventor: Gregory D. Geise, w148 n7040 Terriwood Dr., Menomonee Falls, Wis. 53051

[21] Appl. No.: 09/173,077

[22] Filed: Oct. 14, 1998

Related U.S. Application Data

[60] Provisional application No. 60/062,890, Oct. 20, 1997.

[51] Int. Cl.[7] ..... B30B 9/32

[52] U.S. Cl. ..... 100/258 A; 100/283; 100/293; 100/902; D15/123

[58] Field of Search ..... 100/258 A, 283, 100/293, 902; D15/123

[56] References Cited

U.S. PATENT DOCUMENTS

| | | | |
|---|---|---|---|
| D. 324,390 | 3/1992 | Byers | 100/902 |
| 625,838 | 5/1899 | Devore | 100/283 |
| 828,055 | 8/1906 | Robinson | 100/293 |
| 1,817,210 | 8/1931 | Salsbury | 100/257 |
| 4,290,354 | 9/1981 | Stevens | 100/902 |
| 4,394,834 | 7/1983 | Lowe | 100/902 |
| 4,498,385 | 2/1985 | Manley | 100/902 |
| 4,890,552 | 1/1990 | Yelczyn | 100/902 |
| 5,584,239 | 12/1996 | Yelczyn et al. | 100/902 |
| 5,692,436 | 12/1997 | Pishioneri . | |
| 5,775,213 | 7/1998 | Hyde . | |

*Primary Examiner*—Stephen F. Gerrity
*Attorney, Agent, or Firm*—Joseph S. Heino

[57] ABSTRACT

An aluminum can crushing mechanism includes a support base which has a pair of support members extending from it. Situated between the support members is a pair of compacting plates. The compacting plates utilize a pair of alignment rods, one plate having the alignment rods affixed therewithin and the other plate being functionally adapted to be movable along the alignment rods. Rotatably affixed to the movable plate is a handle member which, when rotated from a generally upwardly extending position to a downward position, causes the compacting plates to move towards each other thereby compacting an aluminum can located between the compacting plates. When the handle member is rotated upwardly, the compacted can drops out from the mechanism without further handling of it.

4 Claims, 3 Drawing Sheets

ALUMINUM CAN COMPACTING MECHANISM

This application claims the benefit of U.S. Provisional Application No. 60/062,890, filed Oct. 20, 1997.

FIELD OF THE INVENTION

This invention relates generally to mechanisms for crushing or compacting objects. More particularly, it relates to an aluminum can compacting mechanism which is manually actuated by a user or consumer and which utilizes gravity to discharge the crushed can from the mechanism thereby eliminating the need to manually remove the compacted can therefrom.

BACKGROUND OF THE INVENTION

The ability to recycle objects has progressed in the last few years from being environmentally trendy to being a necessity for the preservation of resources for our future generations. Recycling of virtually anything that can be recycled has become a way of life in our energy-conscious society. No less important in this regard is the lowly, but ever omnipresent, aluminum can. The aluminum can is found virtually everywhere that beverages are sold or distributed. And, unfortunately, discarded aluminum cans are equally ready to find. Accordingly, a movement has been taking place in the experience of this inventor to manufacture, distribute and sell aluminum can crushing and compacting mechanisms which can be readily purchased and used by the consuming public.

The driving force behind this activity is the fact that aluminum cans have also become a much sought-after commodity. From the small children who gather discarded cans in the sandlot to their parents who collect cans in a household bin, the need to crush and compact aluminum cans has been recognized as a concomitant necessity to the reduction of shear bulk.

Such compaction has taken the form of stomping a can with one's foot to bulk compactors which can be found in parking lots and at the local aluminum recycling facility. Between those extremes are a number of small, wall-mountable, home-made and commercially available can compaction mechanisms. In the experience of this inventor, such mechanisms typically utilize a can retaining means into which the user or consumer manually places the aluminum can which is intended to be crushed. A lever, or similar mechanism, is actuated and the aluminum can is crushed between at least two crushing members or plates. The lever is then reversed and the crushed can is manually removed from the device. In the experience of this inventor, the last step of this process can be, and often is, an unpleasant one because of the presence of beverage residue which often accompanies such cans. Moreover, it is, in the eyes of this inventor, a completely unnecessary step and one which he has sought to eliminate by the construction of the device of the present invention.

SUMMARY OF THE INVENTION

It is, therefore, a principal object of this invention to provide a new, useful and uncomplicated can compacting mechanism which utilizes a minimum number of elements, which is easy to assemble and which is easy to use. It is another object of this invention to provide such a mechanism which is relatively inexpensive to manufacture and which may, as in the preferred embodiment, become a relatively inexpensive item to members of the purchasing and consuming public. It is yet another object to provide such a mechanism having a built-in feature which eliminates the need for the user or consumer of the device to manually remove the compacted can from the mechanism. This effectively speeds up the process of compacting a number of cans and eliminates altogether the need to handle cans twice—once when putting them into the mechanism and then again when removing them.

The present invention has obtained these objects. It provides, in the preferred embodiment, for an aluminum can crushing mechanism which includes a support base which has a pair of support members extending from it. Situated between the support members is a pair of compacting plates. The compacting plates utilize a pair of alignment rods, one plate having the alignment rods affixed therewithin and the other plate being functionally adapted to be movable along the alignment rods. Rotatably affixed to the movable plate is a handle member which, when rotated from a generally upwardly extending position to a downward position, causes the compacting plates to move towards each other thereby crushing an aluminum can located therebetween. The foregoing and other features of the device of the present invention will be further apparent from the detailed description which follows.

DETAILED DESCRIPTION

Figure 1:
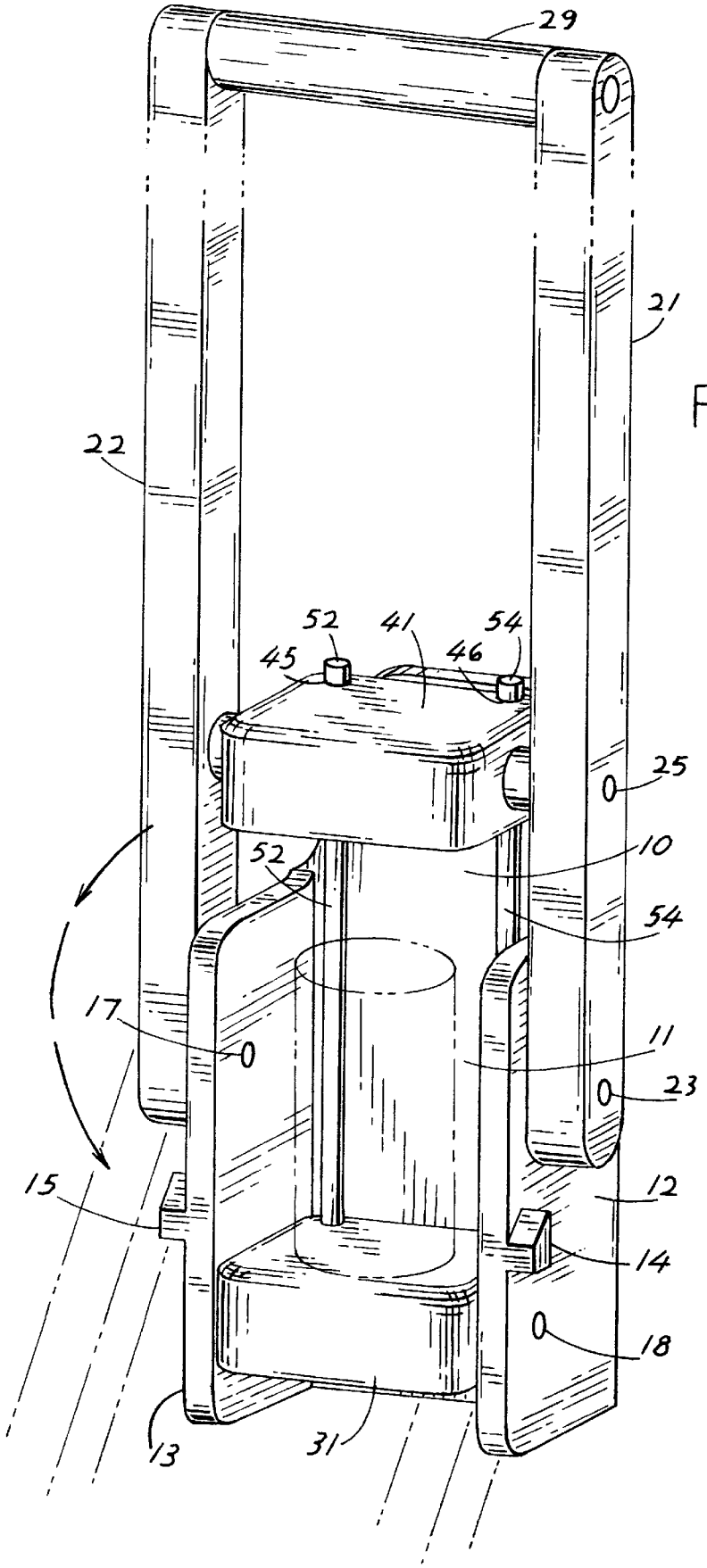
FIG. 1 is a perspective view of an aluminum can crushing mechanism constructed in accordance with the present invention.
Figure 2:
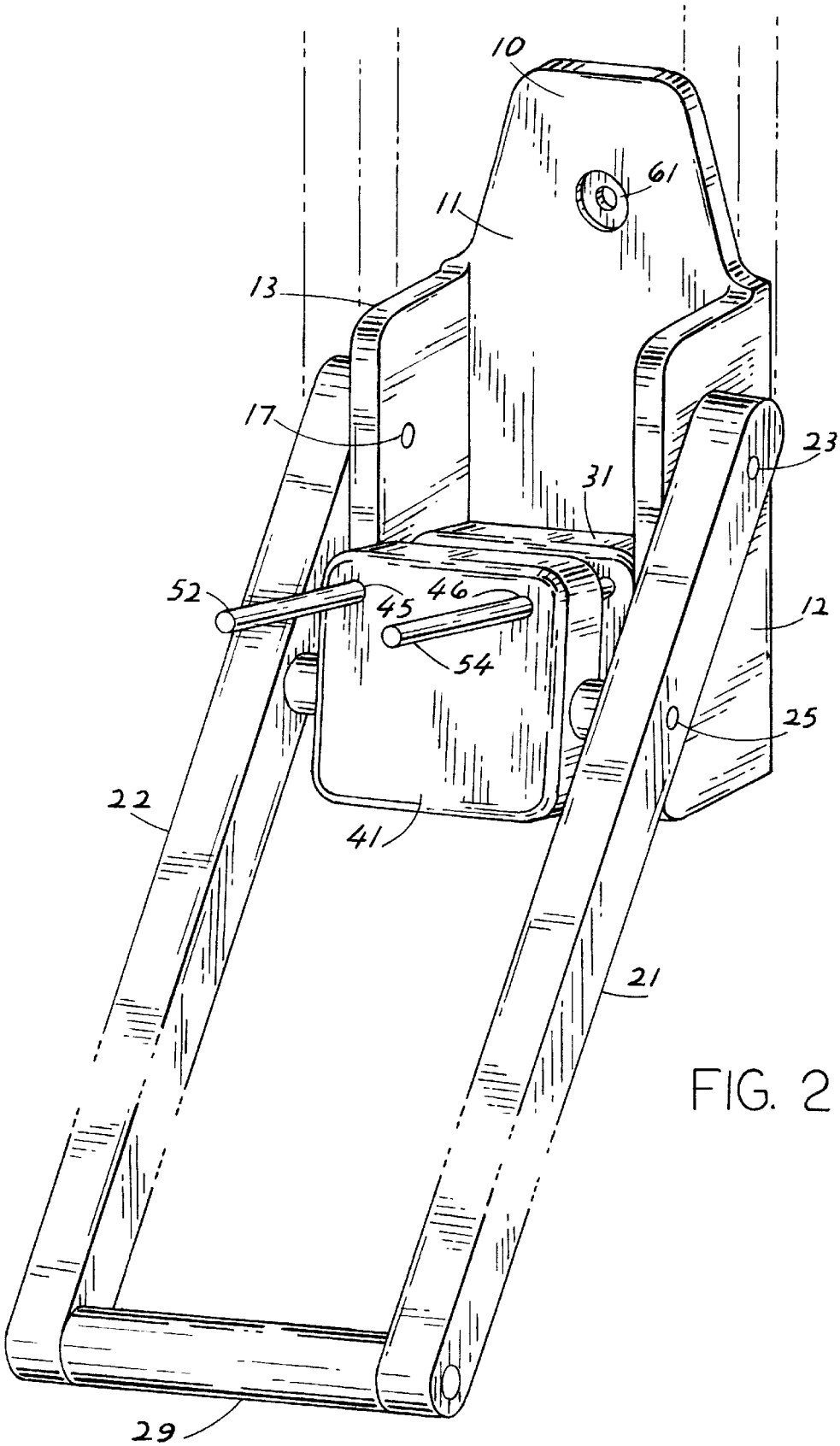
FIG. 2 is another perspective view of the lift assembly shown in FIG. 1 but showing the mechanism in its full compaction or handle lowered position.

Referring now to the drawings in detail, FIG. 1 illustrates an aluminum can compacting mechanism which is constructed in accordance with the present invention. The can compacting mechanism includes a base member 10 having a base back support portion 11. The back support member 11 of the base 10 is comprised of a generally flat planar member which is functionally adapted to be anchored to a generally flat and generally vertical surface. A plurality of mounting holes 61 are provided for affixing the base member 10 to the object which is intended to support it.

Extending generally perpendicularly from the back support member 11 of the base member 10 are a pair of base side support members 12, 13. The base right side support member 12 and the base left side support member 13 are generally parallel to one another. Each side support member 12, 13 is provided with a plurality of holes or openings. For example, the base right side support member 12 includes a bottom hole 18 and a top hole 16, the purpose and function of which will become more apparent further into this detailed description. The base left side support member 13 is likewise configured with a bottom hole 19 and a top hole 17. The top hole 17 of the base left side support member 13 is collinear with the top hole 16 of the base right side support member 12. Similarly, the bottom hole 19 of the base left side support member 13 is collinear with the bottom hole 18 of the base right side support member 12.

Each of the side support members 12, 13 is provided with a side stop member 14, 15, respectively. The stop members 14, 15 are situated to the outside surfaces of the side support members 12, 13, respectively. The function of the side stop members 14, 15 will be further apparent later in this detailed description.

The can compacting mechanism of the present invention also includes a pull mechanism. The pull mechanism includes a right pull member 21 and a left pull member 22. At the distal end of each of the right and left pull members 21, 22 is a handle member 29. The proximal end of the right pull member 21 includes a pivot hole 23. Similarly, the left pull member 22 includes, at its proximal portion, a pivot hole 26. Located away from the pivot hole 23 of the right pull member 21 is a top pressure plate hole 25. A counterpart is comprised of a top pressure plate hole 24 in the left pull member 22.

The can compacting mechanism of the present invention also includes a bottom pressure block 31. The bottom pressure block 31 includes a generally flat top surface. The sides of the bottom pressure block 31 are functionally adapted to fit within the base side support members 12, 13. A second, and complimentary, block, a top pressure block 41, is included and is generally configured to be of the same physical dimensions as the bottom pressure block 31. Each of the top and bottom pressure blocks 41, 31 are configured with rearwardly located holes through which two alignment rods 52, 54 are intended to pass. The alignment rods 52, 54 are fastened at one end within the bottom pressure block 31 and are functionally adapted to remain rigid therewithin. The alignment rods 52, 54 are functionally adapted to freely pass through the holes 45, 46 of the top pressure block 41. The purpose and function of this feature of the present invention will be more apparent latter in this detailed description.

The can compacting mechanism of the present invention is assembled by taking the base member 11 and locating the bottom pressure block 31 between the right and left side support members 12, 13, thereof. The bottom hole 18 of the base right side support member 12 and the bottom hole 19 of the base left side support member 13 are aligned such that a pivot rod (not shown) may be passed through each of them and also through the bottom pressure block 31. In this configuration, the bottom pressure block 31 rotates freely about the rod located between the base right side support member bottom hole 18 and the base left side support member bottom hole 19. Although the bottom pressure block 31 is functionally adapted to rotate freely about the rod, the rod is rigidly fixed at each end within the base right and left side support members 12, 13. Similar rods are likewise situated within the distal ends of the right and left pull members 21, 22, through the top hole 16 of the base right sides support member 12 and through the top hole 17 of the base left side support member 13. In this configuration, the right and left pull members 21, 22 are able to freely rotate about the top holes 16, 17 of the base right side support member 12 and base left side support member 13, respectively. The alignment rods 52, 54 are rigidly affixed rearwardly of and within the bottom pressure block 31. The top pressure block 41 freely slides over and onto the alignment rods 52, 54 such that the top pressure block 41 and the bottom pressure block 31 are generally parallel to one another. The right pull member top pressure plate hole 25 is aligned with the left pull member 22 top pressure plate hole 26 such that a pivot pin is placed therethrough and which extends through the top pressure block 41. As is true with the bottom pressure block 31 as it relates to the base right side support member 12 and the base left side support member 13, the top pressure block 41 is allowed to freely rotate about the pin (not shown) which is situated between the top pressure plate hole 25 of the right pull member 21 and the top pressure plate hole 26 of the left pull member 22.

Figure 3:
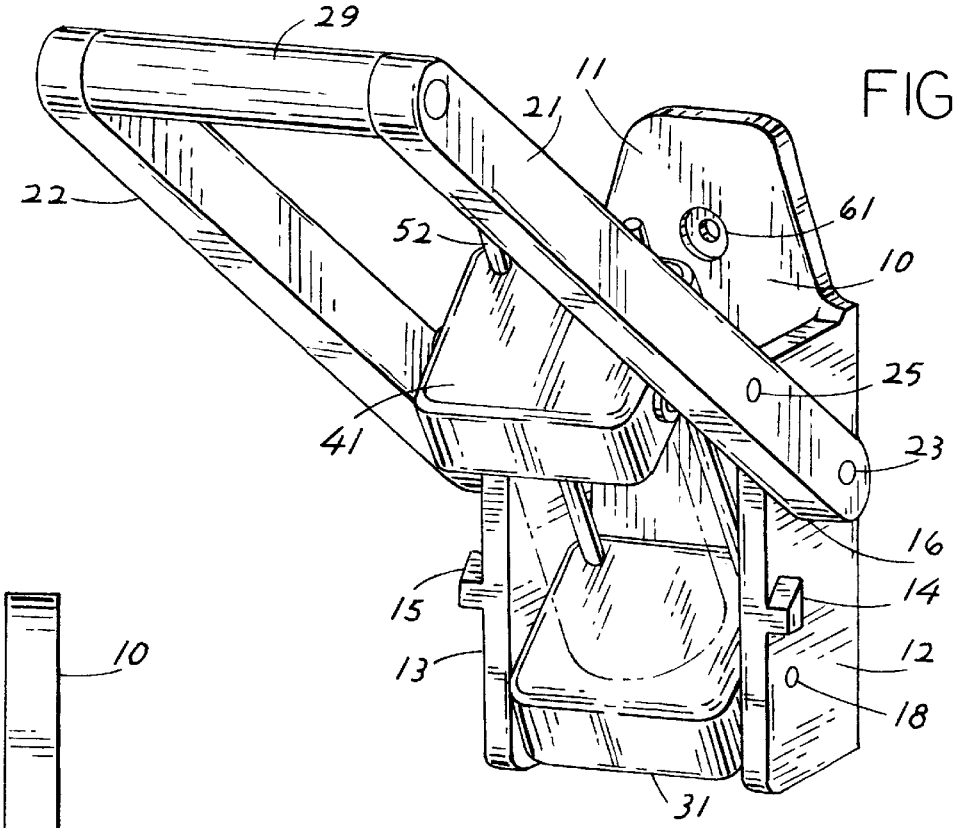
FIG. 3 is another perspective view of the lift assembly show in FIGS. 1 and 2 but showing the mechanism in a partial compaction position.
Figure 4:
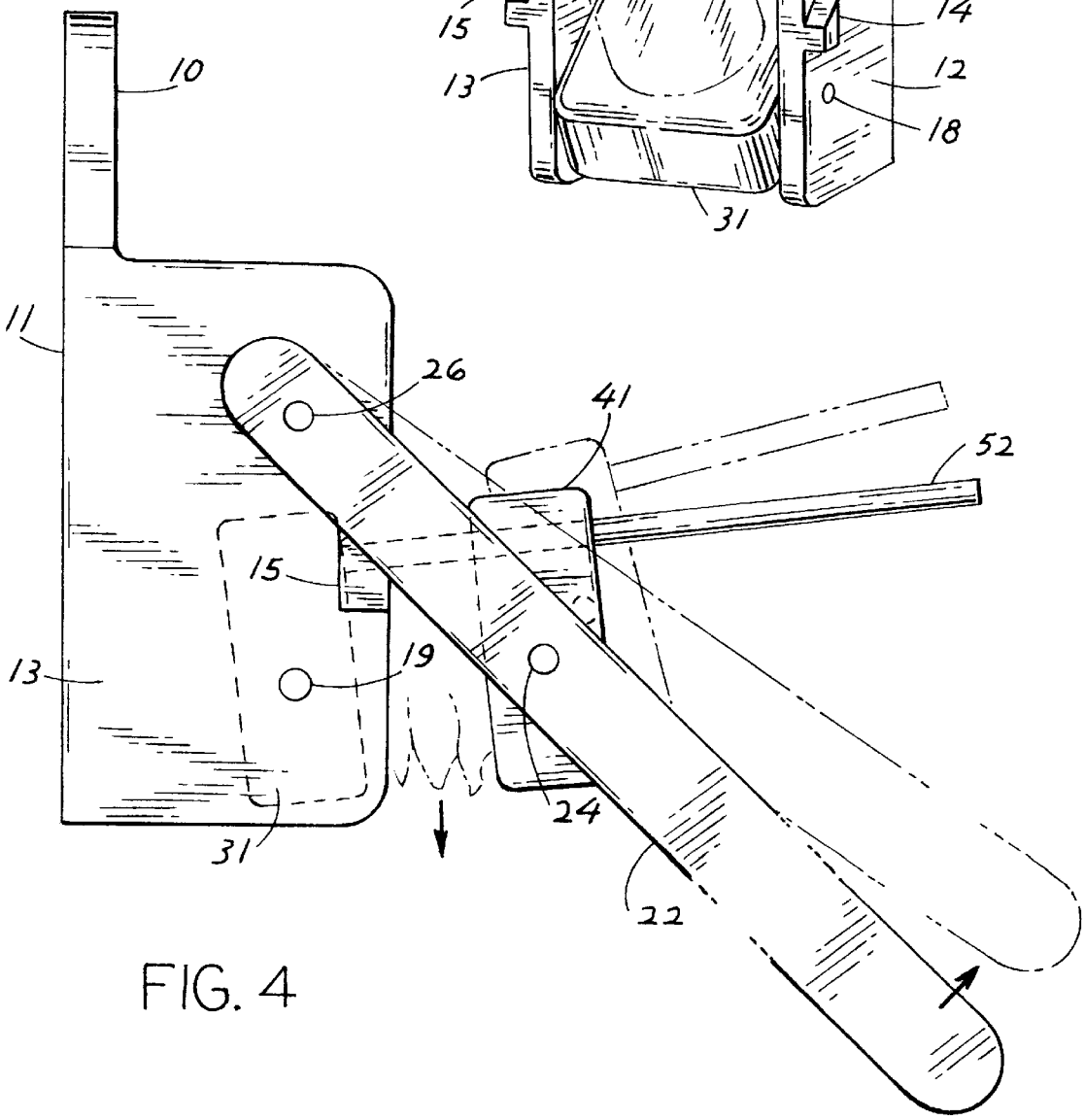
FIG. 4 is a left side elevational view of the mechanism as shown in FIG. 2 in its full compaction or handle lowered position.

In application, a typical 12 ounce aluminum can is situated within the opening created between the bottom pressure block 31 and the top pressure block 41. This is accomplished when the handle member 29 is in its fully upright position. See FIG. 1. This is also when the right and left pull members 21, 22 are in their generally vertical positions. With the aluminum can located between the top pressure block 41 and the bottom pressure block 31, the user of the can compacting mechanism urges the handle member 29 generally downwardly with a gentle gliding and arcuate motion. See FIG. 3. As the handle member 29 moves through its rotation (i.e., from a position where the right and left pull members 21, 22 are in their generally vertical position to their somewhat lower position), the bottom pressure block 31 and the top pressure block 41 begin to rotate in relation to the base member 10. It is fully intended, and in fact practiced, by this invention that the top pressure block 41 and the bottom pressure block 31 always remain in perpendicular planes. In this fashion, the aluminum can located between the bottom pressure block 31 and the top pressure block 41 is less inclined to "pop out" from within the opening created between the blocks 31, 41 which insures proper functioning of the device. As the handle member 29 is pulled downwardly, the top pressure block 41 continues to be urged along the alignment rods 52, 54 and downwardly towards the bottom pressure block 31. As this downward motion is continued, the top pressure block 41 and the bottom pressure block 31 continue in their rotation relative to the base member 11. As the handle member 29 continues its downward movement, the movement of the right pull member 21 is stopped by the base right side stop member 14 located on the base right side support member 12. Similarly, motion of the left pull member 22 is stopped by the presence of the base left side stop member 15 located on the base left side support member 13. At this point, the can which is located between the top pressure block 41 and the bottom pressure block 31 is in its fully compacted condition. The handle member 29 is then moved upwardly to begin the opening cycle of the mechanism. This motion causes the top pressure block 41 to begin its upward motion along the alignment rods 52, 54 and away from the bottom pressure block 31. With the handle member 29 in its fully upright position, the aluminum can, now crushed, drops out from within the crushing mechanism without the need for handling the compacted can. The handle member is then raised to its fully upright position and a new aluminum can can be inserted therewithin for a new compacting cycle to begin.

From the foregoing detailed description, it will be apparent that there has been provided a new, useful and uncomplicated can compacting mechanism which utilizes a minimum number of elements in its construction; which is easy to assemble and easy to use; which is relatively inexpensive to manufacture; which is a relatively inexpensive product for members of the consuming public; and which has a built-in feature which eliminates the need for the user or consumer to manually remove the compacted can from the mechanism thereby effectively speeding up the process of compacting a number of cans and eliminating altogether the need to handle cans twice.

The principles of this invention having been fully explained in connection with the foregoing, I hereby claim as my invention:

1. An aluminum can compacting mechanism which comprises a support base, said support base being functionally adapted to be attached to a generally vertical surface, a pair of base extension members, each of said base extension members extending generally perpendicularly from said vertical surface and having an upper portion and a lower portion, a handle member, said handle member being connected to and extending between the upper portions of said base extension members and being movable between a generally upwardly extending position and a substantially downwardly extending position, a first compacting block, said first compacting block being rotatably connected to and extending between the lower portions of said base extension members and having a top planar surface, a second compacting block, said second compacting block being rotatably connected to said handle member and having a bottom planar surface, means for keeping the top planar surface of said first compacting block and the bottom planar surface of said second compacting block in substantially parallel planar relation, means for drawing the top planar surface of said first compacting block and the bottom planar surface of said second compacting block toward each other when said handle member is moved downwardly from its upwardly extending position, a pair of stop members formed integrally with said base extension members, said stop members being functionally adapted to stop the downward movement of said handle member, and means for releasably dropping a crushed can from said mechanism.

2. The aluminum can compacting mechanism of claim 1 wherein said planar block keeping means comprises a plurality of block alignment rods extending generally perpendicularly from the top planar surface of said first compacting block.

3. The aluminum can compacting mechanism of claim 2 wherein said block drawing means includes a plurality of holes defined within said second compacting block, each of said holes extending inwardly of said second compacting block along lines which are generally perpendicular to the bottom planar surface of said second compacting block and further being functionally adapted to slidably receive a block alignment rod there within.

4. The aluminum can compacting mechanism of claim 3 wherein said can dropping means comprises means for dropping a compacted can from said mechanism when said handle member is moved upwardly from the stop members.

* * * * *